US008184835B2

(12) United States Patent
Goodwin

(10) Patent No.: US 8,184,835 B2
(45) Date of Patent: May 22, 2012

(54) TRANSDUCER ARRAY WITH NONUNIFORM ASYMMETRIC SPACING AND METHOD FOR CONFIGURING ARRAY

(75) Inventor: Michael M. Goodwin, Scott's Valley, CA (US)

(73) Assignee: Creative Technology Ltd, Singapore (SG)

( * ) Notice: Subject to any disclaimer, the term of this patent is extended or adjusted under 35 U.S.C. 154(b) by 1262 days.

(21) Appl. No.: 11/250,740

(22) Filed: Oct. 14, 2005

(65) Prior Publication Data

US 2007/0086606 A1 Apr. 19, 2007

(51) Int. Cl.
*H04R 5/02* (2006.01)

(52) U.S. Cl. ..... 381/303; 381/307; 381/182; 381/300

(58) Field of Classification Search ..... 381/116, 381/335, 307, 119, 182, 17, 303, 300, 92, 381/386

See application file for complete search history.

(56) References Cited

U.S. PATENT DOCUMENTS

| | | | | |
|---|---|---|---|---|
| 5,374,124 | A * | 12/1994 | Edwards | 381/351 |
| 5,953,432 | A * | 9/1999 | Yanagawa et al. | 381/335 |
| 7,319,641 | B2 * | 1/2008 | Goudie et al. | 367/138 |
| 2006/0095254 | A1 * | 5/2006 | Walker et al. | 704/207 |
| 2006/0151237 | A1 * | 7/2006 | Oxford et al. | 181/199 |
| 2006/0182298 | A1 * | 8/2006 | Stiles et al. | 381/335 |
| 2006/0204022 | A1 * | 9/2006 | Hooley et al. | 381/117 |

* cited by examiner

*Primary Examiner* — Vivian Chin
*Assistant Examiner* — Paul Kim
(74) *Attorney, Agent, or Firm* — Creative Technology Ltd

(57) ABSTRACT

A transducer array includes speaker drivers having nonuniform asymmetric spacing. The array includes at least three drivers formed along a line or arc. The first of the drivers is positioned having a first spacing from an adjacent second driver that is different from a second spacing between the second driver and its adjacent third driver.

21 Claims, 12 Drawing Sheets

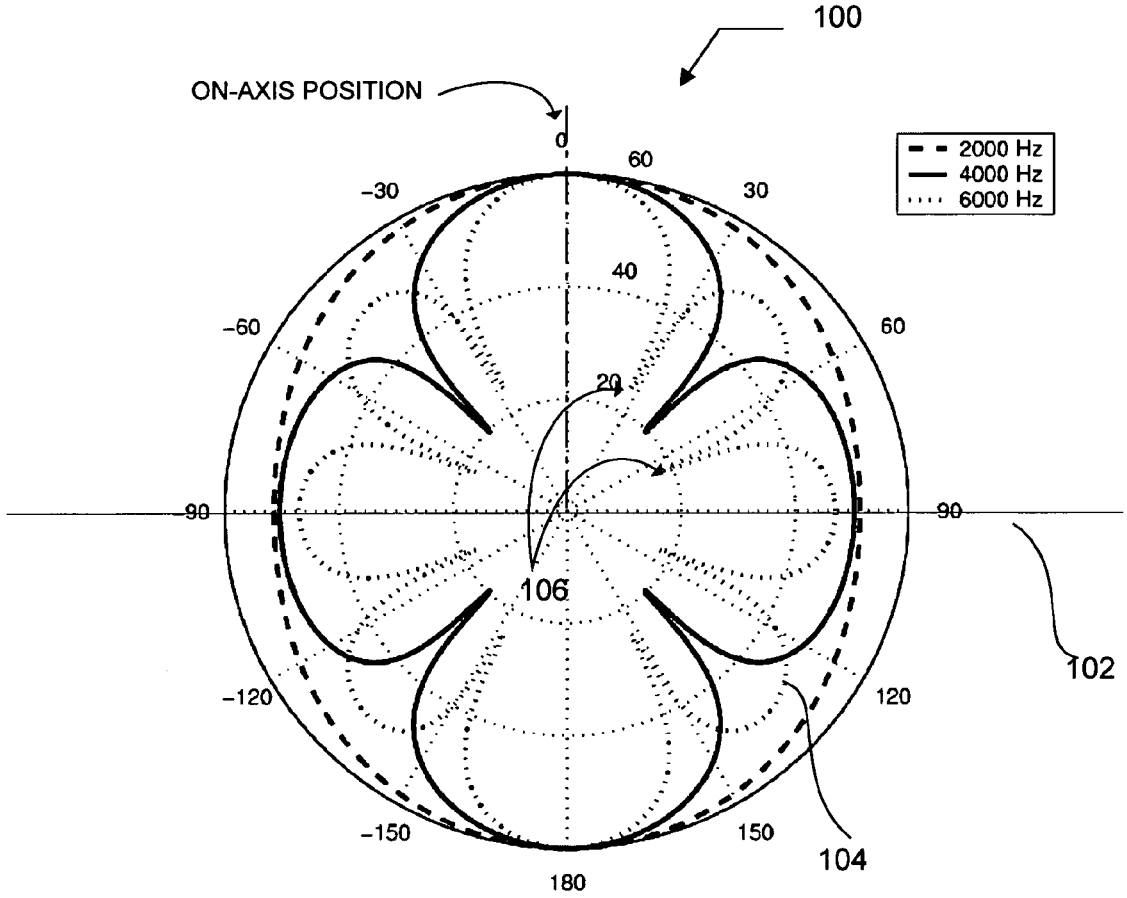
*Fig._1A* *(Prior Art)*

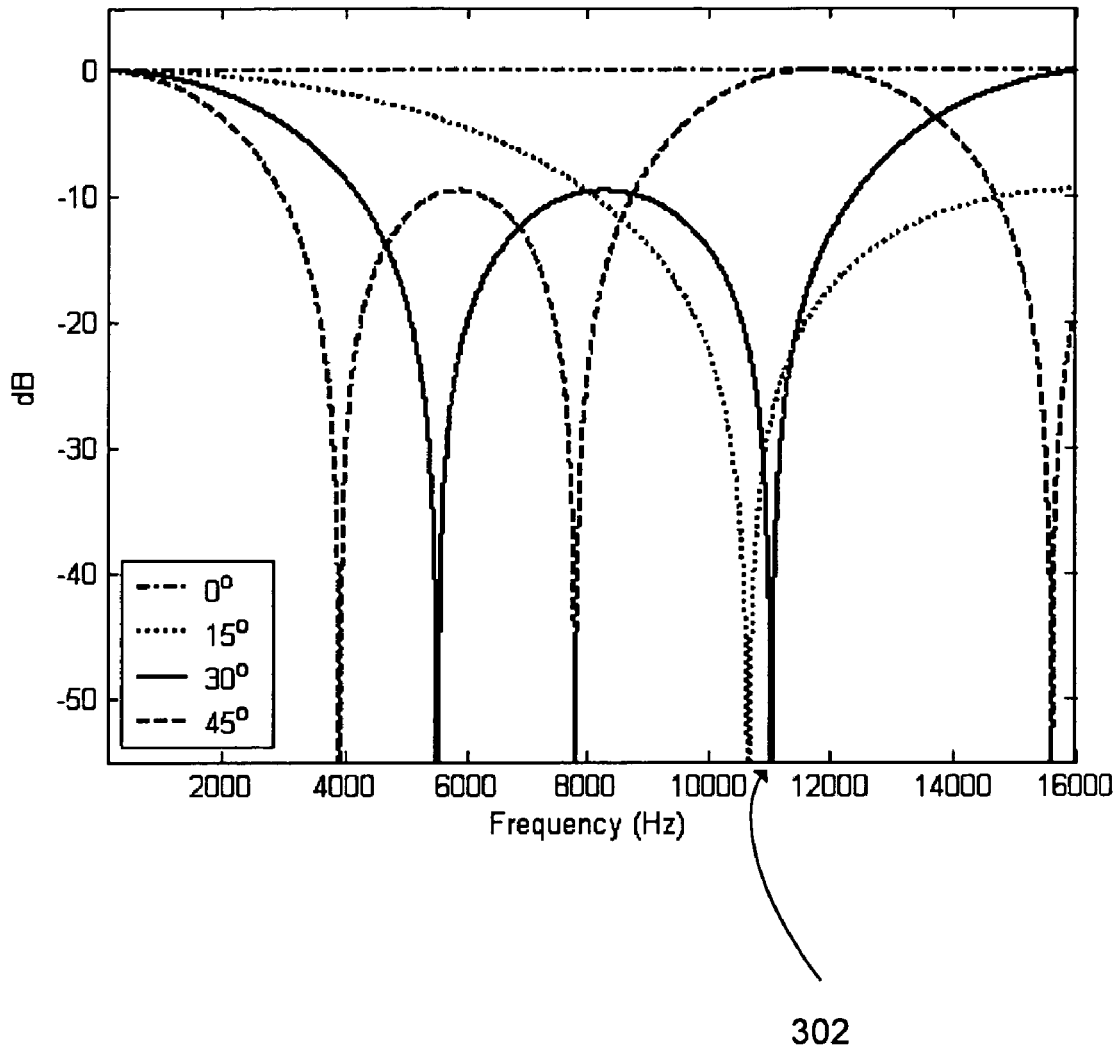
*Fig._3A* *(Prior Art)*

TRANSDUCER ARRAY WITH NONUNIFORM ASYMMETRIC SPACING AND METHOD FOR CONFIGURING ARRAY

BACKGROUND OF THE INVENTION

1. Field of the Invention

The present invention relates to transducers. More particularly, the present invention relates to arrays of audio speakers, microphones, or other sensors or transducers.

2. Description of the Related Art

Audio speakers continually undergo revisions in attempts to balance aesthetic appeal, sound quality, enclosure configurations, and manufacturing cost. Recent trends have focused on providing an array of speakers to optimize cost, style, number of drivers and power considerations. Generally, the array has been formed in a line, i.e., a "linear array". Unfortunately, the frequency response of a linear array is not nearly as omnidirectional as that of a single driver. Speaker arrays having a plurality of speaker drivers are nonetheless popular because of their ability to increase the sound pressure level (SPL) in direct proportion to the number of drivers, thereby providing SPLs comparable to that of larger single drivers while using inexpensive small drivers. Their popularity is also due in part to the styling flexibility they provide.

The most basic configuration of a line array includes a group of speaker drivers arranged in a straight line with uniform spacing between the drivers, and with the drivers operating with equal amplitude and in phase. Other configurations involve out of phase electrical coupling of the drivers but these configurations usually compromise the output power. The basic configuration generally displays omnidirectional characteristics at low frequencies but exhibits attenuation and response notches or troughs at higher frequencies and off-axis positions. This response behavior is often referred to as "lobing". That is, as the wavelengths of the respective frequencies reproduced approach the spacing between the speaker drivers, the uniform response disappears. This occurs because the sound characteristics at any position and frequency are a function of constructive and destructive interference caused by the sound waves emanating from the individual drivers in the array. Generally, the sound waves combine constructively on axis, i.e., at a normal to a line passing through the array drivers. For off-axis positions, i.e., at angles non-orthogonal to the line passing through the array drivers, frequency-dependent destructive interference can occur.

Destructive interference is significant in its effects on the frequency response of the array, particularly for a listener who is moving or in a listening position perhaps close to the ideal position but not precisely at the optimal position. This optimal listening position has generally been referred to as the sweet spot of a speaker or a group of speakers and generally includes on-axis positions. As the angle to the listener departs from the normal (on-axis) position, the destructive interference effects become more apparent. Particularly with increasing frequencies, the effects from the destructive interference are more pronounced, resulting in smaller sweet spots or regions.

Methods in the prior art require frequency-selective filtering, weighting, and/or out-of-phase coupling of the elements, all of which compromise the broadband output power.

It is therefore desirable to provide an array of speakers having an improved frequency response over a wider range of off-axis angles and hence an increased sweet spot. It is furthermore desirable to provide such an improved frequency response while minimally compromising the output power of the array.

SUMMARY OF THE INVENTION

The present invention provides an array of electrically coupled transducers (such as loudspeaker drivers or microphones) spaced in a nonuniform and asymmetric manner. The spacing of the transducers is selected to provide a flatter frequency response at off-axis positions.

In accordance with a first embodiment, a speaker system is provided comprising an array of speaker drivers. The array comprises at least three electrically coupled drivers with the spacing between a first driver and an adjacent second driver different from the spacing between the second driver and an adjacent third driver. According to yet another embodiment, the spacing between the first and second drivers is one half of the spacing between the second and third drivers in the array.

In accordance with another embodiment, a method of determining an optimized configuration for drivers in an array is provided. The method comprises selecting a first test configuration from a plurality of potential positions suitable for placement of the plurality of drivers in the array and changing the test configuration to a second configuration, different from the first. The frequency response for each test (candidate) configuration is evaluated using a discrete-time Fourier transform (DTFT). For each test configuration, the magnitude of the greatest attenuation of the frequency response is determined. The method preferably involves iteration over many possible configurations followed by a selection of the best configuration. One of the test configurations for the array is selected based on a comparison of the maximum attenuation associated with the particular array test configuration. Preferably, the array configuration is selected by minimizing the maximal attenuation. The selected array has the least severe destructive interference in the listening region.

In accordance with another embodiment, the incoming signal is filtered into at least two bands. A low frequency band signal preferably uses all of the drivers in the array while a high frequency band signal is directed to a subset of the array of drivers. The spacing of the drivers in the subset enhances the frequency response by minimizing the notches or troughs caused by destructive interference.

In accordance with yet another embodiment, a method of determining an optimized configuration of drivers or transducers in an array is provided. A grid of candidate positions suitable for placement of a plurality of transducer elements is utilized. A first candidate configuration for each of at least a first, second, and third transducer in the array is selected with each of the drivers corresponding to a unique position in the grid. A second candidate configuration is selected for each of the first, second, and third transducers in the plurality, each of the transducers corresponding to a unique position in the grid, the second test or candidate configuration being different from the first. The responses of the array in the first and second candidate configurations are evaluated. According to a preferred embodiment, the evaluation is completed using a discrete-time Fourier transform using the DFT (discrete Fourier transform) implemented as an FFT. For each of the first and second candidate configurations the maximum attenuation over a predetermined response range or frequency band is compared. One of the first and second candidate configurations for the array is selected based on a comparison of the values of the maximum attenuation. According to one embodiment, the comparison includes a comparison of the deepest trough for each configuration and the selection comprises selecting the configuration having the highest signal value for the trough and further includes storing the trough value as a stored trough value associated with its corresponding configuration.

These and other features and advantages of the present invention are described below with reference to the drawings.

BRIEF DESCRIPTION OF THE DRAWINGS

FIG. 1A is a polar diagram illustrating the directional response of a conventional three-element uniform array at various frequencies.

FIG. 3A is a graphical plot illustrating the frequency response of a conventional three-element uniformly spaced linear array at various angles.

DETAILED DESCRIPTION OF PREFERRED EMBODIMENTS

Figure 1B:
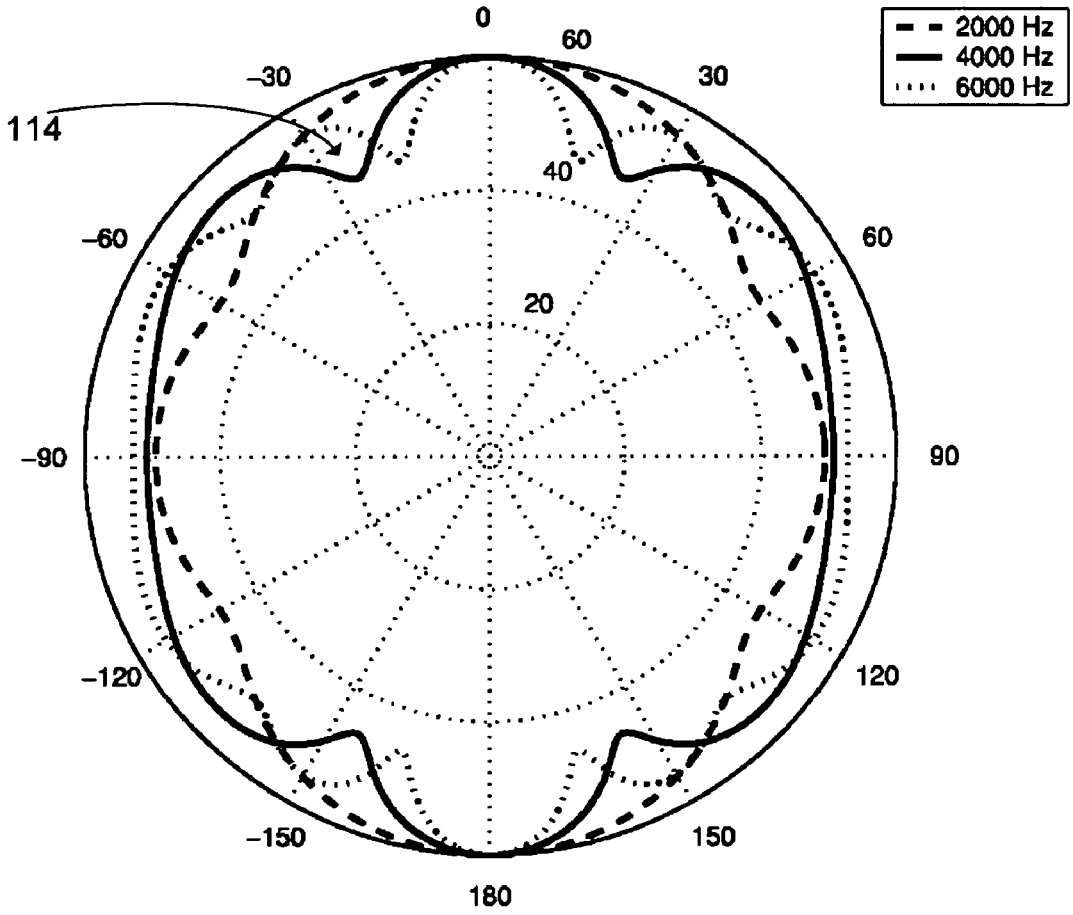
FIG. 1B is a polar diagram illustrating the directional response of an asymmetric linear array having nonuniform spacing in accordance with one embodiment of the present invention.

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative. Further to the extent that details as to methods for forming a product or performing a function are illustrated in the drawings, it is understood that those details may be adapted to any apparatus shown in the drawings suitable for performing that function or suitable for configuration using the results of the method as though those same method details were fully illustrated in the drawing containing the apparatus.

Various embodiments of the present invention provide an array of transducers such as speaker drivers spaced in a nonuniform and asymmetric manner. By selecting the spacing between the active drivers, i.e., the electrically coupled drivers, the array of the drivers can be controlled to provide an optimal response in terms of angle and frequency corresponding to the particular design parameters selected for the array. Throughout this specification, speaker drivers and/or arrays of speaker drivers may be referenced. It should be understood that these references are provided for illustrative purposes without loss of generality regarding the use of any other types of transducers.

Line arrays conventionally consist of a group of uniformly spaced speaker drivers operated in phase to provide an alternative that can be cheaper to produce than a single large driver (i.e., each of the drivers in the array can be significantly smaller and cheaper than a single large driver) but which still deliver comparable sound pressure levels. Moreover, an array of smaller drivers may be desirable to provide a configuration more adaptable to different situations, e.g., to fit in a limited space or an oddly configured space that would be unsuitable for a larger individual speaker driver.

Unmodified linear arrays generate directionality in the sound produced. The sweet spot is the listening area where the sound purity is optimized. Typically this location is located perpendicular to a line intersecting the drivers in the array and is referred to as "on-axis". This optimized region is often limited in size despite the intentions of designers to expand it as much as possible. Unfortunately, even minor movements from the on-axis position can result in appreciable variations in the listening experience. That is, due to the limited size of the sweet spot arising from destructive interference of sound waves from the plurality of speaker drivers in the array, the listeners perceive a small sweet spot and degraded frequency response outside of the sweet spot. Smaller sweet spots inhibit listener movement or the grouping of several listeners to enjoy the full fidelity of the audio reproduced.

The present invention in various embodiments overcomes many of these limitations by arranging the speaker drivers in the array in a nonuniform and typically asymmetric manner. By doing so, the degree of constructive and destructive interference of the sound waves emanating from the drivers in the array is controlled such that the listening experience is improved and a flatter frequency response is provided at listening positions outside the nominal sweet spot. That is, the frequency-dependent signal attenuation at off-axis positions is decreased.

The conventional array with uniform spacing presents lobes showing significant attenuation as illustrated in FIG. 1A. FIG. 1A is a polar diagram illustrating the frequency response of a conventional array. For illustration purposes, line 102 represent the line of a linear array of speakers. The diagram 100 illustrates for several frequencies the sound pressure levels (SPL) at the various off-axis positions as well as the on-axis position (i.e., perpendicular to the line of the linear array). For these simulations, the array included 3 elements with a uniform spacing of 4 cm between elements. For reference purposes, the on-axis position is shown at 0 degrees. The depicted responses correspond to the far-field response of the array. The polar response at three selected frequencies is shown, i.e., at 2000, 4000, and 6000 Hz. For example, at 6000 Hz, shown by reference numeral 104, nulls in the magnitude are shown at approximately +27 and +67 degrees from the on-axis position. Accordingly, listener positioning at those off-axis positions results in the severe attenuation of the sounds at those frequencies.

Generally in arrays, the narrowness of the lobe is a frequency-dependent function of the length of the array. The main lobe narrows with increasing frequency. Moreover, attenuation increases with both off-axis position and frequency. To be specific, as the listener moves farther off-axis, the frequency response will exhibit a lower cutoff. For discussion purposes here, cutoff refers to a predetermined attenuation of a signal, for example a decrease in signal strength to the attenuation level defined as the cutoff.

The points of the array response showing the greatest attenuation are often referred to as nulls. As used in this specification, "null" does not necessarily refer to an absolute zero value but rather in general a dip or trough in the response. An example of such a null or response minimum is shown by reference numeral 106 for the 6000 Hz. polar response plot 104. Here, at a position about 27 degrees off-axis, a severe drop in intensity occurs. As shown by comparison of the plots for the frequency response at 4000 and 6000 Hz, respectively, the number of response nulls increases with an increase in frequency. This is due to the fact that at the higher frequencies the sound wavelength approaches and then becomes less than the spacing between the drivers in the array.

Various embodiments of the present invention avoid these deep nulls by spacing the drivers in the array in a nonuniform and asymmetric manner. For example, FIG. 1B is a polar diagram, determined from a Matlab simulation, illustrating the frequency response of an asymmetric linear array having nonuniform spacing in accordance with one embodiment of the present invention. As with FIG. 1A, the polar response at three selected frequencies is shown, i.e., at 2000, 4000, and 6000 Hz. Here, the frequency response is flatter and avoids deep drop-offs in magnitude of the array response (i.e., deep nulls). For example, the plot for the response at 4000 Hz shows a worst null position at a position 114 that is about 25 degrees off axis. Here, the worst-case signal attenuation (i.e. the depth of the deepest trough) is much less than that of FIG. 1A.

Figure 2A:
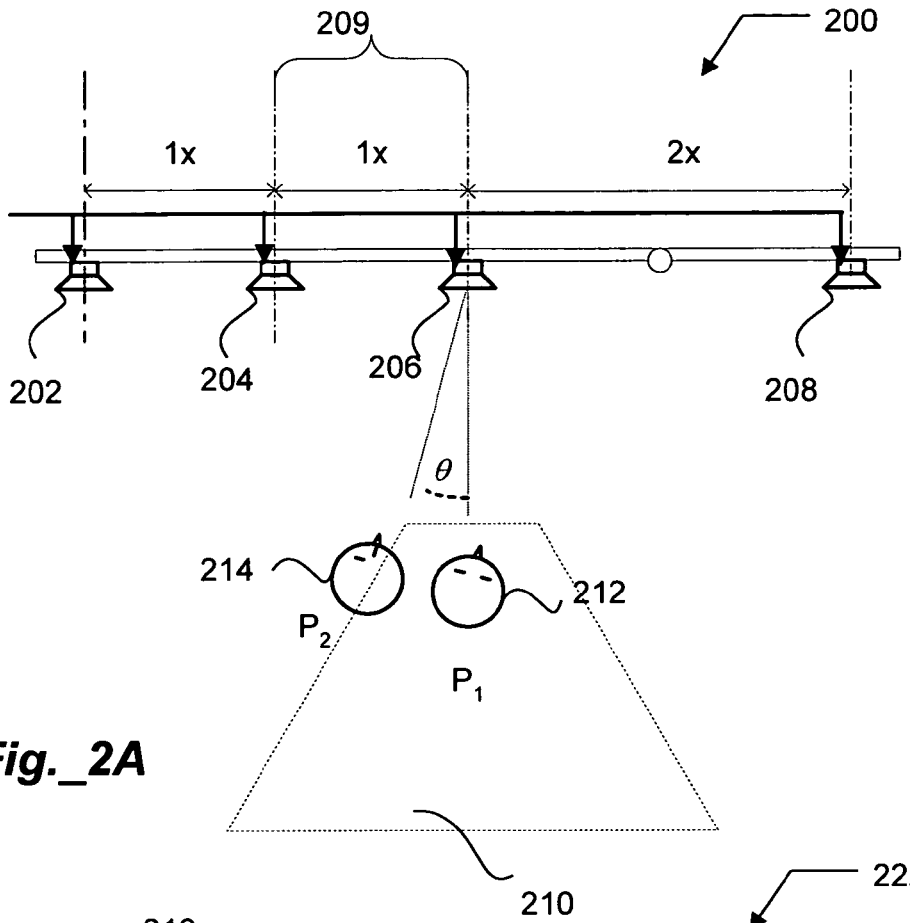
FIG. 2 is a diagram illustrating array configurations in accordance with embodiments of the present invention.

Embodiments of the present invention avoid the harsh drop-off in response by varying the spacing between the electrically coupled drivers (or other transducers) such that the spacing in an array having at least three drivers is generally nonuniform and asymmetric. By configuring the array in this manner, the "deep" nulls in the frequency response can be avoided. FIG. 2A is a diagram illustrating an array configuration in accordance with one embodiment of the present invention. The nonuniform and asymmetric array 200 includes a plurality of drivers, 204, 206 and 208, for example. In accordance with one preferred embodiment, the spacing between the electrically coupled drivers is selected such that the distance between the second (206) and third (208) drivers is twice the distance between the first (204) and second (206) drivers. It is to be understood that the array may comprise any number of elements beyond three, such as the four element array illustrated by the addition of driver 202.

To illustrate further with respect to FIG. 2A, the distance 209 between a first driver 204 and an adjacent second driver 206 is one half the distance between the second driver 206 and a third driver 208 (adjacent to the second driver 206). This configuration provides an optimal configuration for an array having three or four drivers based on the shallowest null metric proposed in embodiments of the present invention. That is, in such arrays, by doubling the spacing for the third driver in the array relative to its adjacent second driver as compared to the spacing between the second driver and its adjacent first driver, "deep" nulls in the array response are avoided. FIG. 2A illustrates an array comprising all "active" drivers. That is, all of the drivers physically provided in the array are electrically coupled. By arranging the drivers in this manner, the listener at an off-axis position 214, varying from the on-axis position 212 by angle θ can enjoy the same or nearly the same full fidelity as the listener at position 212. This avails the listener with a larger sweet spot or sweet region 210.

Figure 2B:
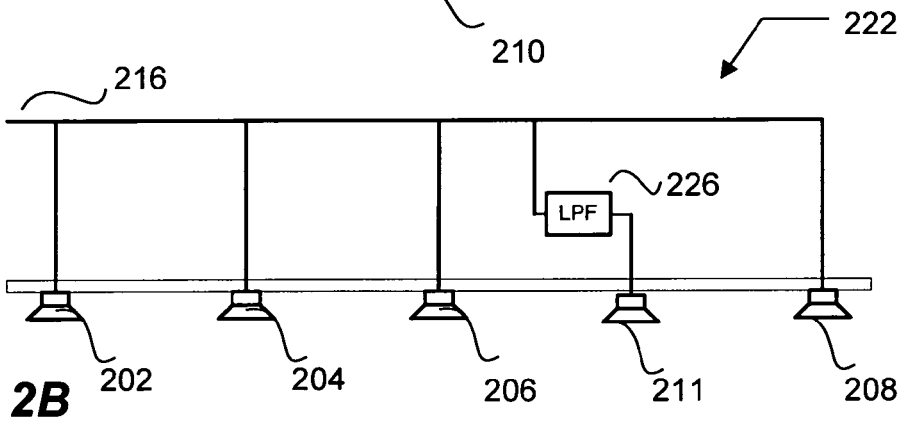

One alternative method of producing electrically coupled drivers having nonuniform and asymmetric spacing involves providing an array chassis or base having a plurality of uniformly spaced drivers. Electrically isolating one or more of the uniformly spaced drivers can achieve the nonuniform and asymmetric spacing of the drivers. For example, omitting an electrical connection to the isolated drivers, providing a switch in the connection to the driver(s), or providing a filter to "switch" on and off the audio signal in a frequency-dependent fashion can achieve the desired isolation. FIG. 2B is a diagram illustrating nonuniform spacing of electrically coupled drivers in a uniformly spaced array of drivers. This illustrates the array 222 achieving nonuniform asymmetric distribution of 4 "active" or electrically coupled drivers in a high frequency band from an array of 5 uniformly spaced drivers. This is achieved by providing a low pass filter 226 to cut out the high-frequency signal transmitted to the driver 211. Alternatively, driver 211 may merely be left disconnected from the input signal 216 or switched by other means. Thus, where the transducers are uniformly spaced, conventional arrays can easily be modified to provide an array having improved sound characteristics using the nonuniform and asymmetric limitations described herein. One or more of the uniformly spaced drivers may be switched in or out of operation by any switch mechanism. For example, the scope of the invention is intended to extend to all switching mechanisms without limitation, including mechanical switches, relays, and bipolar and MOS transistors. Further, selected drivers may be inactivated in a frequency-dependent fashion through the use of filters, as further illustrated herein. More particularly, filtering mechanisms permit selecting optimally configured subarrays for each of two or more frequency bands.

The nonuniform and asymmetric spacing changes the pattern of the destructive interference. Preferably, the selection of the nonuniform and asymmetric spacing results in the "deep" nulls of the destructive interference pattern being minimized. More preferably, the array configuration is optimized by using a Discrete-Time Fourier Transform (DTFT) as an analytical tool to optimize the positioning of the drivers.

Figure 2C:
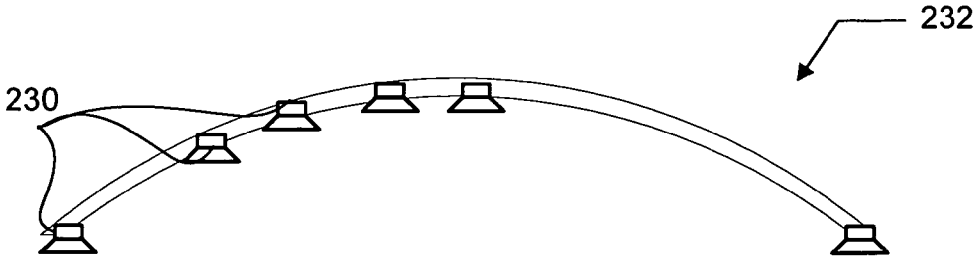

While the foregoing has illustrated linear (i.e., straight line) drivers having nonuniform spacing between adjacent drivers, the spacing representing integer multiples of the spacing between other adjacent drivers, the examples provided are for illustration purposes and are not intended to be limiting. For example, the scope of the invention is also intended to extend to curvilinear arrays as illustrated in FIG. 2C and to all arrays having nonuniform spacing of any dimensions between active elements. That is, the spacing between adjacent active drivers is not limited to integer multiples of the spacing between other pairs of adjacent active drivers. Rather, by using the search algorithm described herein in a preferable manner, any spacing between the transducer elements is only limited to multiples of the small spacing on the underlying search grid, which spacing can be arbitrarily small. Preferably the search is performed on a discrete one-dimensional uniform grid of candidate locations, the grid having an arbitrarily small grid spacing d.

FIG. 2C illustrates a plurality of drivers 230 spaced along a curvilinear array 232. A similar exhaustive search algorithm can also be applied to find the best nonuniform spacing for a circular array—but the array response for each candidate configuration cannot be evaluated with the DTFT as for linear arrays.

FIG. 3A is a graphical plot illustrating the frequency response of a conventional uniformly spaced three-element array with 4 cm inter-element spacing. The array response is plotted for various positions including on-axis (here 0 degrees is defined as the on-axis position) and off-axis (15, 30, and 45 degrees as measured form the on-axis position). The x-axis depicts the frequency (in Hz) whereas the y-axis depicts the attenuation (in dB). As shown, even for off-axis positions as little as 15 degrees, severe attenuation can be experienced at higher frequencies. For example, as designated by reference number 302, the response at 30 degrees shows a true null at approximately 11 kHz, i.e., complete destructive interference.

Figure 3B:
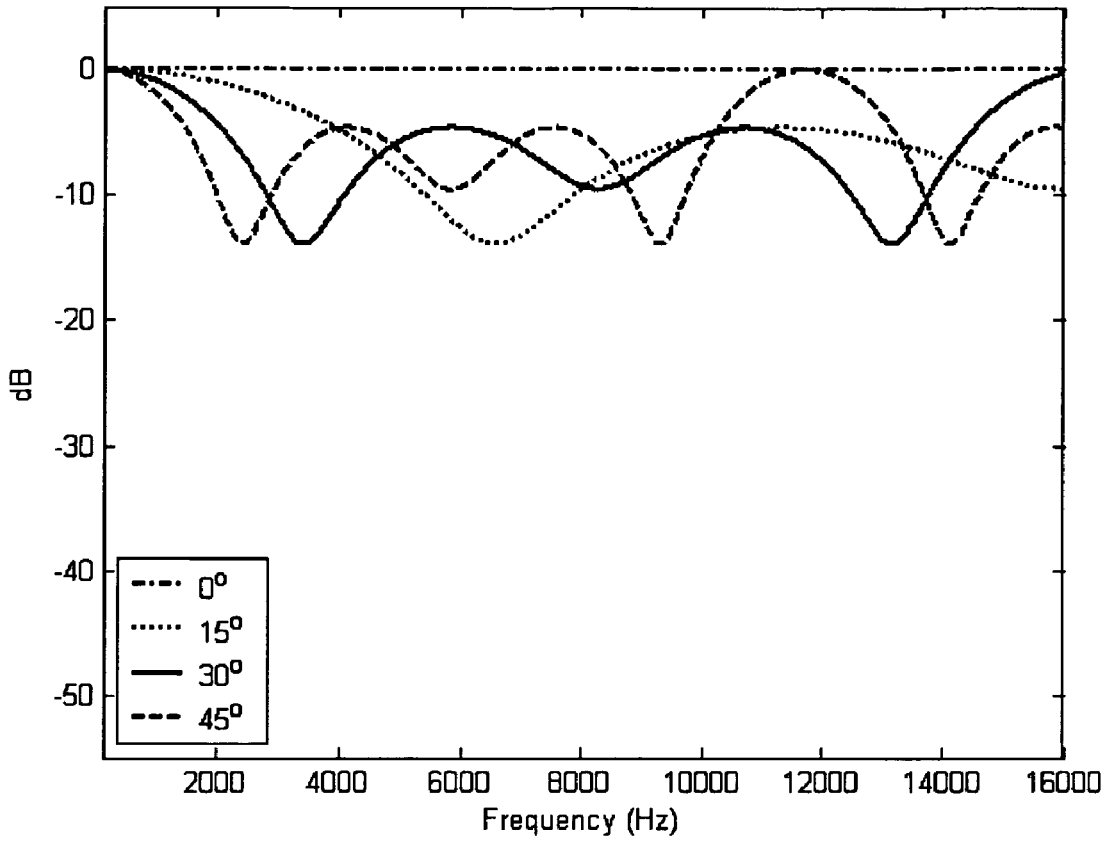
FIG. 3B is a graphical plot illustrating the frequency response at various angles of a three-element asymmetric linear array having nonuniform spacing in accordance with one embodiment of the present invention.

FIG. 3B is a graphical plot illustrating the frequency response of an asymmetric three-element linear array having nonuniform spacing in accordance with one embodiment of the present invention. The same axes scales as depicted in FIG. 3A are used. Attenuation over all measured frequencies was reduced to less than 15 db in all cases.

Figure 4A:
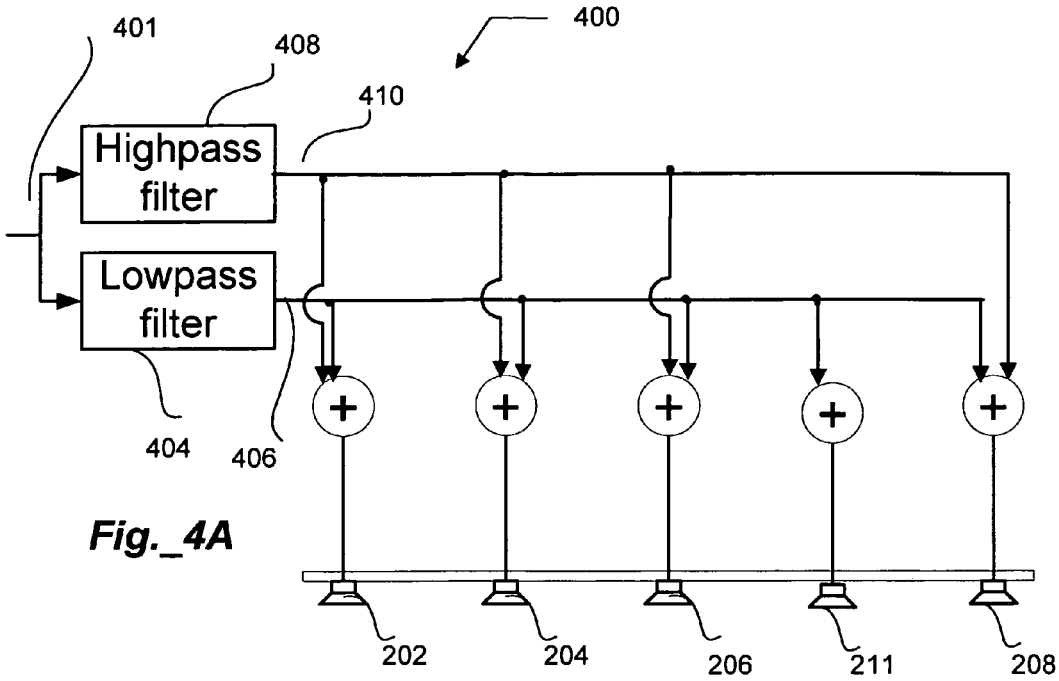
FIGS. 4A-4B are diagrams illustrating array configurations in accordance with a second embodiment of the present invention.

FIG. 4A is a diagram illustrating an array configuration in accordance with another embodiment of the present invention. According to this embodiment, the incoming signal 401 is filtered by a low-pass filter 404 to yield a low-frequency signal 406 and by a high pass filter 408 to yield a high-frequency signal 410. This illustrates the use of crossover-filtered arrays. A crossover-filtered array is an array with frequency-selective filtering which essentially splits the full array into a number of subarrays. The low-frequency signal 406 is preferably routed to an array portion customized for reproduction of the low-frequency signal. Most preferably, this is an array utilizing most or all of the drivers available. For the case of a transmitting array such as a loudspeaker array, this provides an advantage in power radiation; for the case of a receiving array such as a microphone array, this provides an advantage in the power reception. As is known to those of skill in the relevant arts, low-frequency signals play an important role in the perceived volume of audible sounds. In addition, a better low-frequency response is typically associated with a higher quality system in the audio market. Accordingly, by connecting all of the available drivers in the array to the low-frequency signal 406, the array output power is maximized at low frequencies. For example, by connecting all 5 drivers in a 5-element array (e.g., drivers 202, 204, 206, 211, and 208) to the low-frequency signal, the low-frequency sound pressure levels are maximized for the array. The high-frequency signal, conversely, is routed to only a subset of the set of array drivers. For example, as illustrated in FIG. 4A, the high-frequency signal 410 is routed to only 4 of the 5 drivers available. In this configuration, the nonuniform and asymmetric spacing of the drivers enhances the high-frequency response by minimizing the nulls. Since the low-frequency signals are more readily perceived in relationship to loudness of an audible signal, the loudness of the source signal is essentially preserved by routing the low pass filtered signal 406 to all of the available drivers. In addition, since low-frequency signals have less directionality than high-frequency signals (and no nulls), providing the low-frequency portion of the signal using drivers having conventional uniform spacing does not have a detrimental effect on the sweet spot. The scope of the invention embodiment is intended to extend to filtering of incoming signals into any plurality of bands, with the routing of at least one of the respective band signals into a nonuniformly spaced array.

Figure 4B:
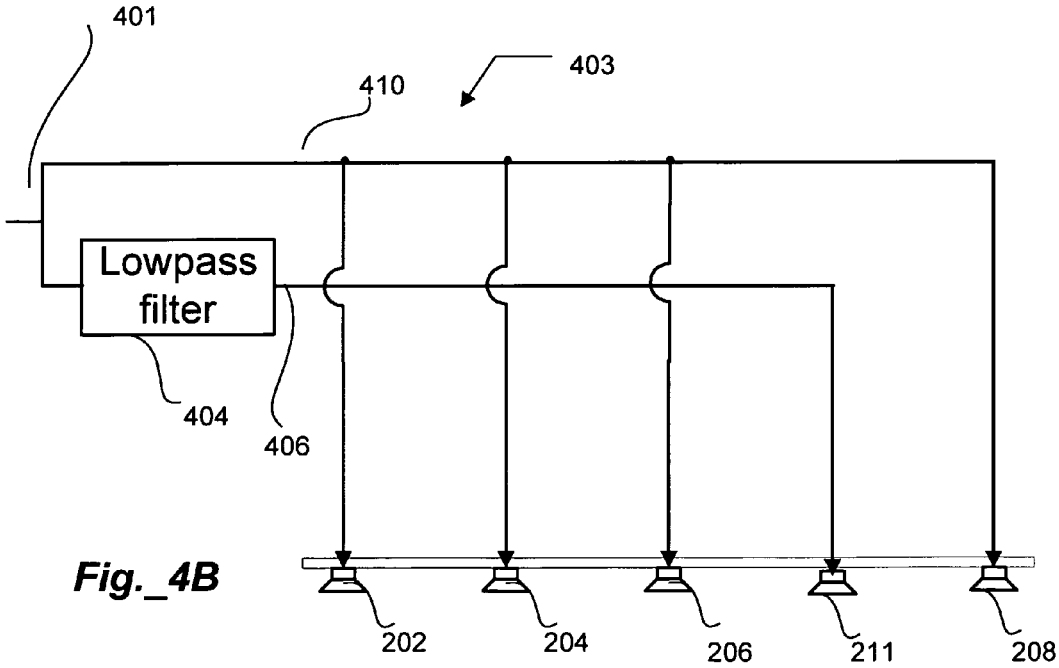

According to another embodiment, the low pass signal is routed to a subset of the drivers having the same number of drivers as the high pass subset. As a result, the same number of drivers are operating in both ranges. By using this configuration, the low/high balance of the input (or output) is maintained. The system in FIG. 4A can be implemented more efficiently in an alternative embodiment by connecting the input signal 401 directly to elements 202, 204, 206, and 208 and connecting the output of the low pass filter 406 to element 211 as illustrated in FIG. 4B. In the system configuration 410 (illustrated in FIG. 4B), transducer 211 is the only element connected to the low pass filter 404.

Figure 4C:
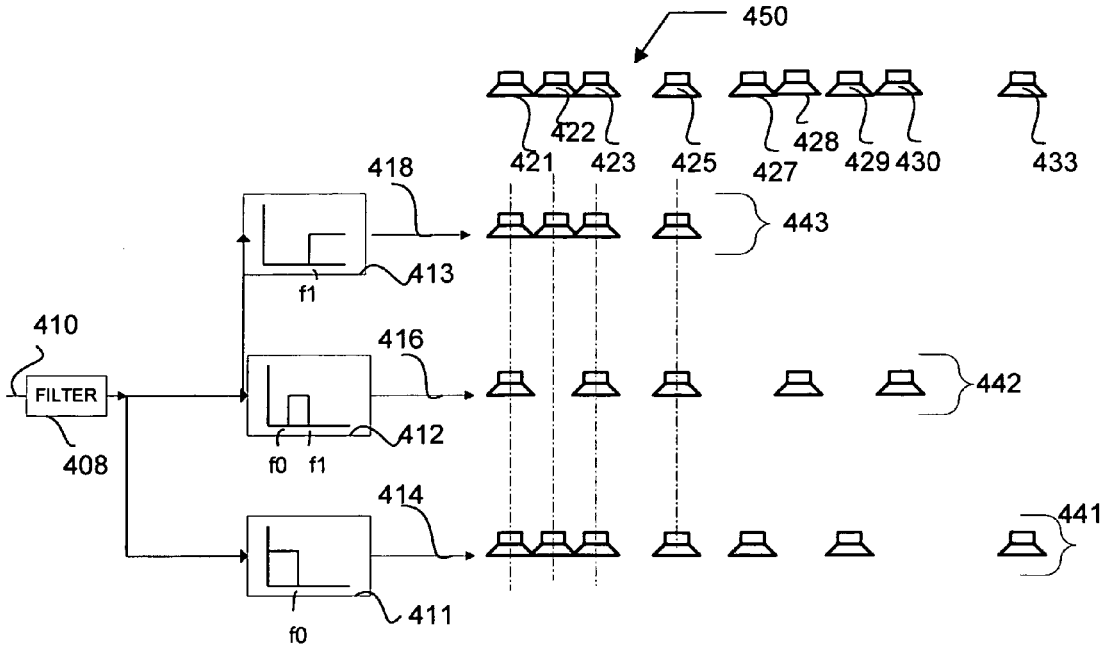
FIGS. 4C-4D are diagrams illustrating array configurations in accordance with embodiments of the present invention.

In accordance with one embodiment, as illustrated in FIG. 4C, the signal is filtered into three or more bands, each of the processed signals routed respectively to an array designed for the selected frequency band. The embodiment illustrated involves design of subarrays for each frequency band and sharing of common elements between these subarrays in the compound full-band array. For example, the signal received at the input 410 (after processing by the optional compensation filter 408) is processed by filters 411-413 into a low band signal 414, representing frequencies in the band from 0 to f0, a mid band signal 416 representing frequencies from f0 to f1, and a high band signal 418 representing frequencies above f1. The compensation filter is used to flatten the broadband response for the case when the different subarrays have different numbers of elements. It should be noted that these examples are illustrative and not intended to be limiting. In one embodiment, f1=2f0, thereby filtering according to octaves. The frequency bands need not correspond to octave bands, however. These distinct signals are preferably forwarded respectively to a low band array 441, a mid band array 442, and a high band array 443. Each of the mid band array 442 and the high band array 443 typically (but not necessarily) would have fewer elements in comparison to the low band array 441.

Although the separate band arrays may be positioned one atop another (in a vertical direction, for example), efficient use of common driver positions in the corresponding bands allows overlapping use of drivers by the respective subarrays, and the realization of the subarrays 441-443 from within a composite array 450. For example, the composite array comprises drivers 421-433. The lowband subarray 441 includes only drivers 421, 422, 423, 425, 427, 429 and 433. In other embodiments, it may be acceptable to use all of the array elements for the low band, depending on the low pass cutoff frequency (if using all of the elements won't result in nulls) and the desired response flatness (if having a different number of low-frequency elements and high-frequency elements is undesirable or can't be compensated for.) The mid band subarray 442 includes drivers 421, 423, 425, 428, and 430. Finally, the high band subarray 443 includes drivers 421, 422, 423, and 425. Thus, drivers 421, 423, and 425 are common to all three subbands. By routing the processed signals appropriately to the respective drivers, the composite array 450 can generate the same sound as the set of distinct subarrays but with a smaller enclosure space for the transducers and with fewer drivers. Preferably, the incoming signal is processed by the compensation filter 408 to flatten the on-axis response if a different number of drivers is used in each band. Thus, FIG. 4C illustrates a nesting embodiment whereby some of the drivers are used for all three bands, others for two of the three bands, and yet others used for only one subband. In the example composite array 450 nine drivers are present, with seven of the drivers operating in the low-frequency subband, five of the drivers in the mid subband, and four in the high-frequency subband. The configurations provided are intended to be illustrative and not limiting. For example, the scope of the invention is intended to extend to arrays subdivided into two, three, four or more subarrays as well as also including different spacing and/or number of drivers and/or effective lengths for each subarray. In some cases, the filters for the subarrays can be reconfigured to make the processing more efficient (as illustrated in FIG. 4B) or to avoid filtering artifacts. That is, if all the bands are to be routed to a common driver, there is no need to filter the signal for that band at all. This only leads to a computational savings, however, if a smaller number of filters can be used in the reconfigured system.

In a preferred embodiment, a multi-band design includes a low array using all of the available elements. The higher frequency bands are then specifically optimized for the desired frequency range and sweet spot region.

Figure 4D:
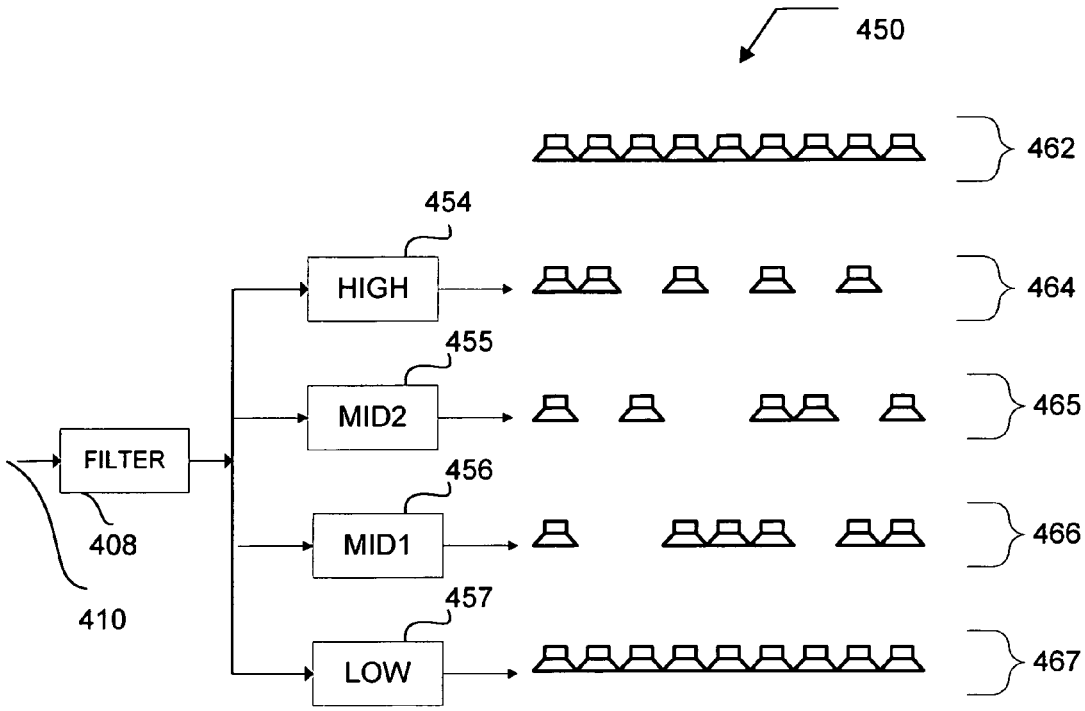

FIG. 4D illustrates an alternative embodiment wherein a composite array includes all uniformly spaced drivers. Similar to the configuration illustrated in FIG. 4C, the input signal 410 is first preferably filtered by a compensation filter 408 and then filtered into subbands that are directed to subsets of the composite array (462) of drivers. Filters 457, 456, 455, and 454 respectively filter the signal 410 into low, mid1, mid2, and high frequency bands. The filtered signals are then directed to selected drivers of the composite array. More specifically, all of the drivers are used in the low-frequency array 467. Different subsets of the composite array 462 of all uniformly spaced drivers make up the MID1 (466), MID2 (465), and HIGH (464) frequency subarrays.

In order to generate a configuration for the spacing between drivers, the various configurations are preferably evaluated to determine those configurations providing the shallowest "deep" nulls. These determinations may be made empirically or, for efficiency purposes, determined using a discrete-time Fourier transform to analyze the frequency response of the test configurations over frequencies in the operating range of the array (or subarray) and angles in the desired sweet region.

Figure 5A:
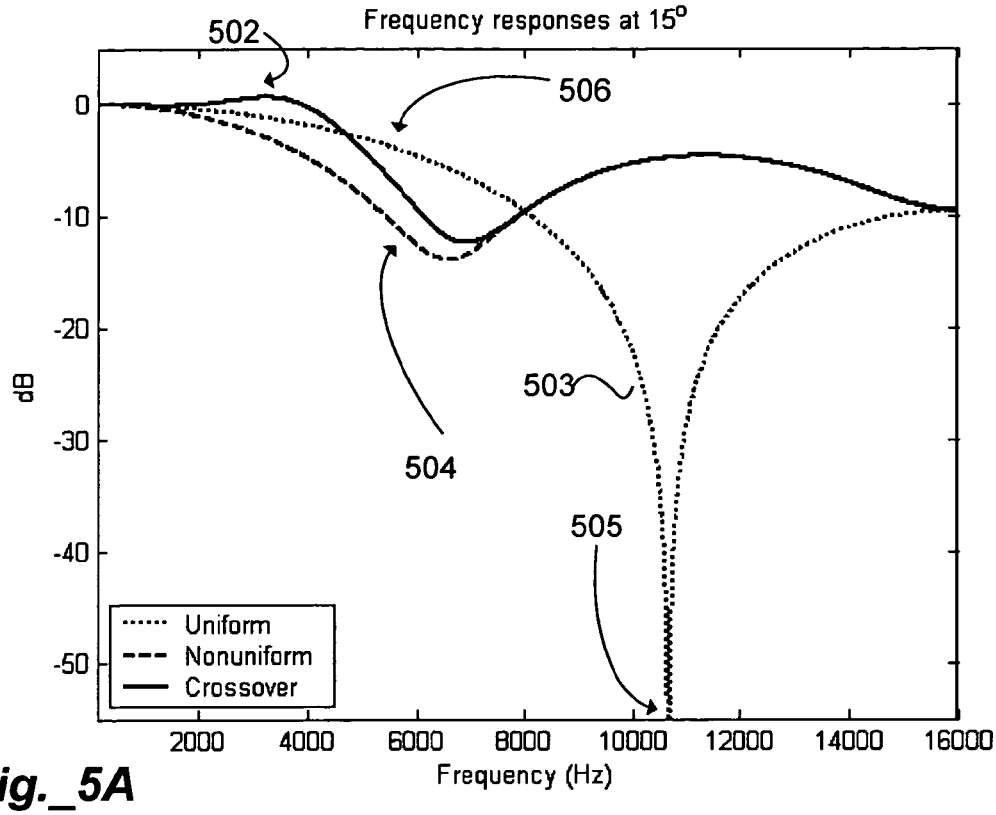
FIGS. 5A-C are graphical plots illustrating specific frequency responses at 15, 30, and 45 degrees for uniform arrays in comparison to nonuniform and crossover-filtered array configurations in accordance with embodiments of the present invention.
Figure 5B:
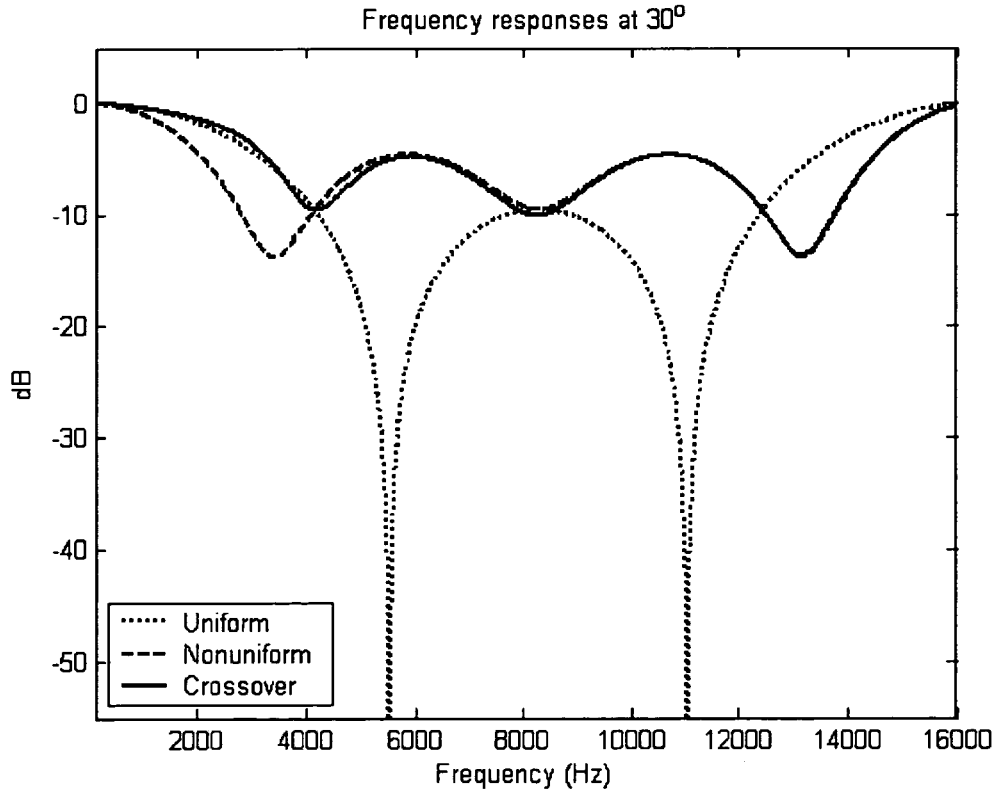
Figure 5C:
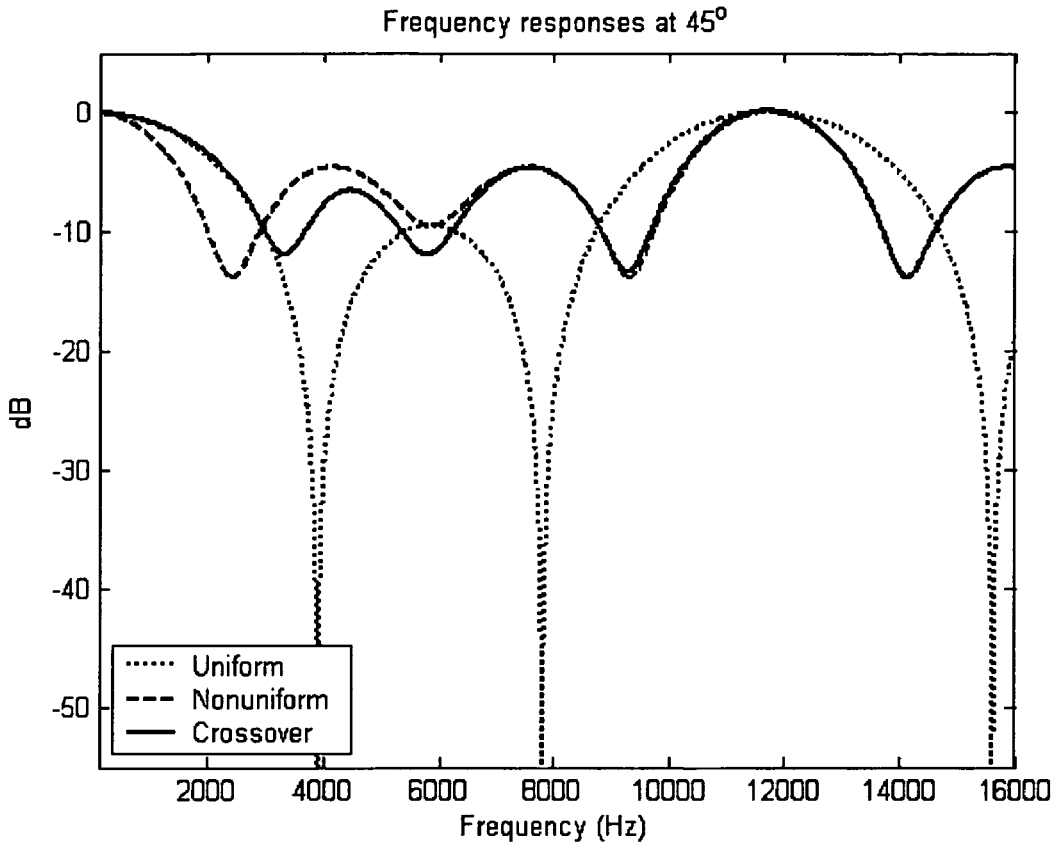

FIGS. 5A-C are graphical plots illustrating specific frequency responses at 15, 30, and 45 degrees for uniform, nonuniform, and crossover-filtered arrays. More specifically, the nonuniform and crossover configurations are provided in accordance respectively with embodiments of the present invention. The plots include a crossover-filtered configuration using a three element array (4 elements in the full array, 3 used in each band). The advantages of the crossover configuration are demonstrated in these figures. In FIG. 5A, the conventional uniform array response 503 indicates that the conventional uniform array operates satisfactorily at low frequencies but not at higher frequencies, where the response exhibits a deep null 505 and a general attenuation. The nonuniform array response 504 exhibits significantly better performance for higher frequencies, but displays some attenuation at low to mid-range frequencies with respect to the uniform array. The crossover-filtered configuration is designed by connecting the drivers generally as in FIGS. 4A, 4B, 4C or 4D. The crossover filter preferably is designed with a transition frequency so that the resulting array uses the uniform array configuration for low frequencies and the nonuniform array configuration for high frequencies, thereby gaining the advantages of each of the respective configurations. For example, as illustrated in FIG. 4B, the uniform array configuration is used for reproduction of low-frequency signals whereas the high pass filtered signal 410 is forwarded to a nonuniform array comprising elements 202, 204, 206, and 208. In this way, the low-frequency signals are recreated as well as in the uniform array at very low frequencies. For higher frequencies, we avoid the deep drop-off 505 by using the optimal nonuniformly spaced subarray instead.

Figure 6A:
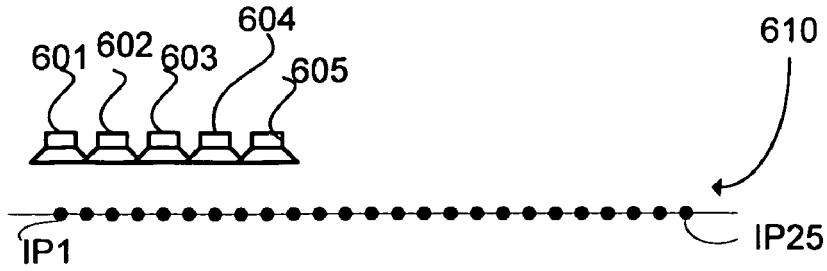
FIGS. 6A-6C are diagrams illustrating the method of using a plurality of test configurations to determine an optimized array configuration in accordance with one embodiment of the present invention.
Figure 6B:
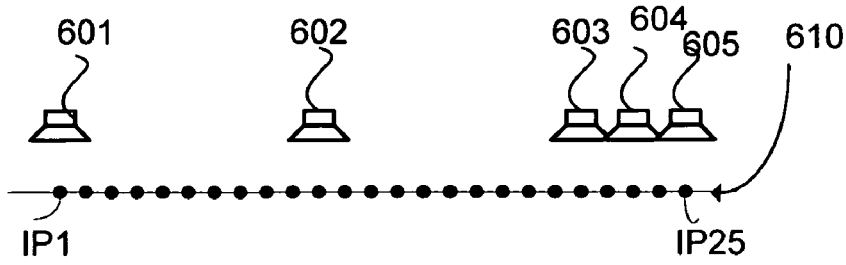
Figure 6C:
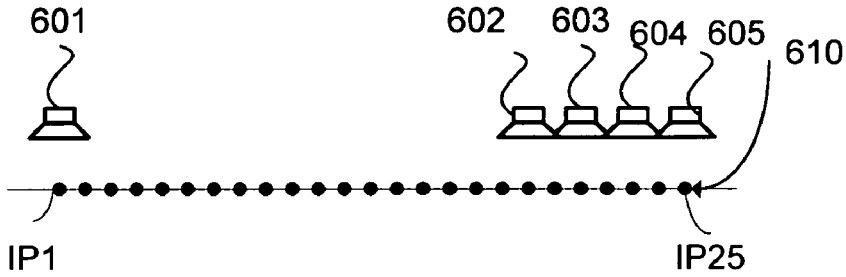

FIGS. 6A-6C are diagrams illustrating the method of using a plurality of test configurations to determine an optimized array configuration in accordance with one embodiment of the present invention. The method tests the performance of the drivers at preferably all test configurations on a grid representing the possible (candidate) speaker locations. According to a preferred embodiment, the grid spacing for the grid of potential array positions is smaller than the minimum driver width. By using such a grid, the array configuration can be optimized to minimize the "deep" nulls in the off-axis frequency response. For example, the driver widths may be 2.5 cm., yet the grid spacing for the analysis may be significantly smaller, for example 1 cm or less. Allowable test configurations are constrained by the effective width of the transducers such that no overlapping or physical coincidence between adjacent array elements occurs.

The number and locations of the possible driver positions are a function of several design constraints including (1) the allowed length of the array, (2) the number of array elements (drivers), and (3) the element size. The first driver (reference numeral 601) is positioned without loss of generality at position IP1 (i.e., the leftmost position in FIG. 6A). Thus the looping progresses, for example, according to the following sample programming code for each element in the array (reference numerals 601-605 in FIG. 6 correspond respectively to driver positions d1-d5):

for $d_2=M,\ d_2<R-(N-2)M$ for $d_3=d_2+M,\ d_3<R-(N-3)M$

.

.

for $d_i=d_{i-1}+M,\ d_i<R-(N-i)M,$ where R corresponds to the number of unit positions in the grid and hence the allowed array length, M corresponds to the width of a driver in grid units, N corresponds to the number of drivers, and $d_i$ corresponds to the particular position of the i-th respective driver on the unit grid. Within the innermost nested loop, the array configuration $d_1, d_2, \ldots d_N$ spans all of the realizable array configurations which satisfy the constraints of the design. This loop thus allows the DTFT to generate a frequency response for each test configuration possible for the array, and hence to determine the shallowest DTFT null from all configurations. For example, in FIG. 6A, with driver 601 set to the first position (IP1), the initial test configuration includes drivers positioned at index points 1, 3, 5, 7, and 9 (IP1, IP3, IP5, IP7, and IP9) in the grid 610 of potential locations. The iterations of test configurations progresses to the final configuration in FIG. 6C (with driver 1 still positioned at index point 1) where the drivers are positioned respectively at IP1, 1P19, 1P21, 1P23, AND 1P25). One of the many intermediate test configurations is illustrated in FIG. 6B. It is not necessary to reposition driver 1 in the test loop. All possible configurations can be tested with respect to their far-field array response magnitude (which is characterized by the DTFT magnitude in the test loop) without repositioning driver 1 in the test loop. For purposes of illustration, the transducers have been illustrated and described as having the same width. However, the scope of the invention is intended to extend to arrays having different widths for different drivers.

The far-field response of a linear array can be expressed as follows:

$$A(f,\theta)=\sum_{n=0}^{N-1} a_n e^{-j2\pi f \frac{d_n}{c}\sin\theta} \tag{1}$$

where n is an array element index, $a_n$ represents the weight of the n-th driver, f represents the frequency, $d_n$ the element position (with respect to a common origin), c the speed of sound, and θ the angle relative to the on-axis position. For a uniform array, $d_n$ may be expressed equivalently as $d_n=nd_0$, where $d_0$ is the uniform inter-element spacing. It should be noted that the angular positions shown in the polar response plots of FIGS. 1A-1B are indicated with respect to the vertical axis (i.e., the on-axis position) and hence these angles correspond to the angles used in Equation (1) and the frequency responses in FIGS. 3 and 5.

Although the response as a function of angle and frequency of various potential array configurations may be experimentally derived, a more efficient method of determining and optimizing the array configuration involves analytical transformations performed on computers. For example, the responses for various configurations at specified angles and frequencies may be computed numerically using standard programming languages or technical computing environments such as Matlab. In accordance with one embodiment of the present invention, the spacing of the drivers in the array is optimized using a Discrete-Time Fourier Transform (DTFT) analysis. As known to those of skill in the relevant arts, the DTFT of a discrete-time sequence $a_n$ is given by:

$$A(\Omega)=\sum_{n=0}^{R-1} a_n e^{-j\Omega n} \tag{2}$$

By considering the array to be a discrete sequence (in space rather than time) and by setting $$\Omega=\frac{2\pi f d\sin\theta}{c} \tag{3}$$

we see that the DTFT expression in (2) can be used to determine the array response formulated in Equation (1). Thus, the response of an array can be determined by performing a DTFT on the array configuration. Since the nulls and troughs in A(Ω) correspond to the nulls and troughs in A(ω,θ), a DTFT analysis can be used to evaluate array configurations and determine the optimized array spacing in the present invention.

According to one embodiment, an array of N drivers in a grid of R possible grid locations is represented by weighting $a_n$ with "1's" and "0's" for each test configuration. The "1" signifies the presence of the driver at the respective grid position whereas a "0" represents no driver present at that location, or at least not one electrically coupled to the audio signal source. In this way, each of the possible test configurations is evaluated and compared to other test configurations to optimize the array. Preferably, the DTFT response for each array configuration is analyzed to determine the deepest null, i.e. the point wherein the frequency-dependent response shows the greatest attenuation. Since this null value for the DTFT corresponds to the nulls in the array response, comparison can be made between the DTFTs of different configurations to optimize the frequency response. The deepest null (trough) value for the test configuration's DTFT is compared to that of other test configurations until the shallowest deepest null is determined for the full set of test configurations. The configuration corresponding to the DTFT with the shallowest deepest null (trough) is then selected as the optimal configuration for placement of the drivers within the available grid spacing.

Figure 7:
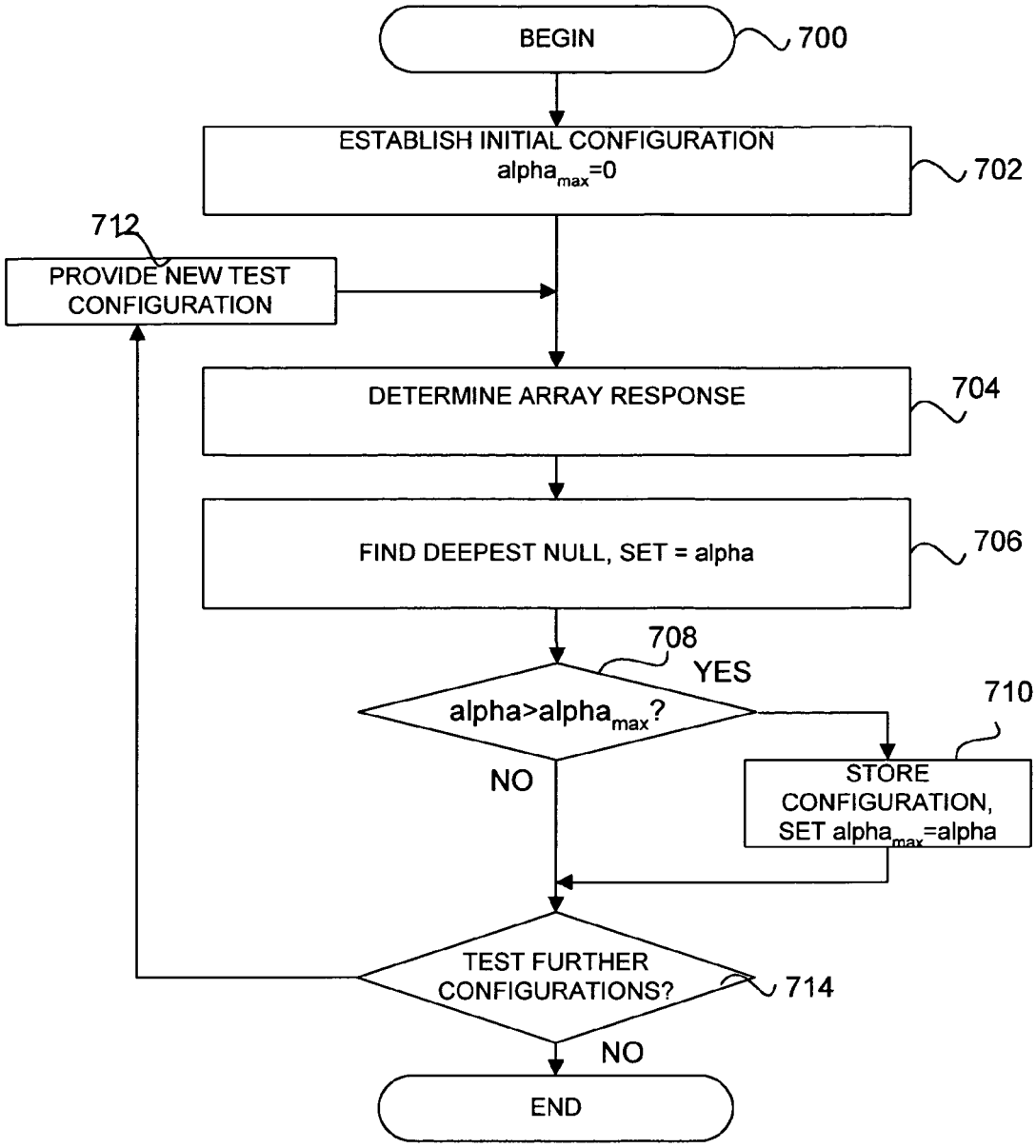
FIG. 7 is a flowchart illustrating a method of determining an optimized configuration for an array in accordance with one embodiment of the present invention.

In accordance with this embodiment, a method of optimizing a configuration of drivers is provided and illustrated in the flowchart of FIG. 7. The procedure begins at operation 700. Next, in operation 702, an initial test configuration for the array is established, i.e., the drivers are positioned in a first configuration in the grid of possible positions. Further, in this operation, $\alpha_{max}$ (representing the magnitude value of the deepest null (trough) across the tested configurations) is set to zero [$\alpha_{max}=0$]. The metric $\alpha_{max}$ represents the highest magnitude value amongst the set of deepest troughs found in the test configurations (where one deepest trough is identified for each configuration). Next, the array response for that configuration is determined in operation 704. The array response is preferably determined using a DTFT implemented using a Fast Fourier Transform. From the data representing the array response, the deepest null is then determined for that configuration in operation 706. That is, $\alpha_i=\min|A(\Omega)|$. This is then compared in operation 708 to the stored value for $\alpha_{max}$ and the new value is substituted in operation 710 for the stored value of $\alpha_{max}$ if greater than the currently stored value. In other words, if $\alpha_i$ is larger than $\alpha_{max}$, then the current test configuration has a shallower deepest trough than found in previous configurations. This enables determination of the shallowest deep null and thus the optimized frequency response. If further test configurations remain to be tested as determined in operation 714, a new test configuration is provided in operation 712 and the process proceeds to operation 704 to determine the array response. That is, the array response A(Ω) is analyzed within a loop over all configurations of $a_n$. The analysis consists of first computing the magnitude of the DTFT of the array response:

$$\text{compute}|A_i(\Omega)|=|DTFT\{a_n(i)\}|$$

where i is an iteration index which indicates the specific test configuration. For each configuration, an array response null depth $\alpha_i$ is determined More particularly, $\alpha_i$ is set to the magnitude of the deepest trough for the array response for each particular test configuration; this is equivalent to the minimum magnitude of the DTFT:

$$\alpha_i=\min|A_i(\Omega)|$$

For each succeeding iteration, $\alpha_i$ is compared to a stored $\alpha_{max}$ and the $\alpha_{max}$ value is replaced if the present configuration's value is greater than the stored value:

$$\text{If } \alpha_i>\alpha_{max}, \text{ then } \alpha_{max}=\alpha_i$$

Thus, each $\alpha_i$ that meets the foregoing standard is the potential best configuration (until a new iteration reveals a more optimal value). The process proceeds to find the DTFT for which the deepest null is the shallowest. This directly leads to an array response with the shallowest nulls.

As discussed earlier, the shallowest deep null is determined by looping through all possible configurations in the grid of possible positions. Once a determination has been made that all test configurations have been tested in operation 710, the process ends (operation 714) with the array configuration associated with the stored value $\alpha_{max}$ representing the optimized configuration.

In the loop over all possible array configurations described above, the search for the deepest null or trough in the function $|A(\Omega)|$ corresponding to a given configuration is carried out over the range $0<\Omega<\pi$. Given the mapping of $\Omega$ to signal frequency f and listening angle $\theta$ in Equation (3) and the symmetry properties of $|A(\Omega)|$ known to those of skill in the art, this range of $\Omega$ corresponds to the complete range of listening angles (−90 degrees to 90 degrees) and signal frequencies. In other words, the function $|A(\Omega)|$ fully characterizes the response of the array configuration for all angles and frequencies.

It should be understood that the process tests the various configurations and measures the response to find the array configuration having the shallowest deepest null or notch and thereby minimizes the depth of the deep nulls. The scope of the invention is intended to extend to all ways of evaluating the deep nulls or notches. Therefore, the invention scope is intended to extend, as would be understood by those of skill in the relevant arts having this specification for guidance, without limitation to methods whereby the evaluation process measures the degree of signal attenuation from an ideal response. For example, according to this alternative, the depth of the deepest null from the "ideal" reference level is compared to the depth of the deepest notch (from the reference level) in a second configuration and the configuration selected that shows a smaller value for this "depth".

In some designs, for instance in the multiple frequency band designs depicted in FIGS. 4C and 4D, it may be of interest to optimize the array configuration for a limited range of frequencies (and/or listening angles). For such cases, the target design range of frequencies (and/or listening angles) can be used to derive corresponding limits for $\Omega$ using Equation (3). Then, the search for the minimum value (deepest trough) of $|A(\Omega)|$ for each configuration is carried out only over this restricted range corresponding to the design constraints. The resulting optimized array configuration will have the best performance (i.e. shallowest deep null) of all possible configurations for the target range of frequencies (and/or listening angles).

By providing nonuniform spacing between active drivers in the array, an enhanced frequency response is obtained. In accordance with another embodiment, an input signal processed and filtered in accordance with at least two bands enables an array to generate a flatter high-frequency response (than the unprocessed array) by selectively routing high-frequency content to a subarray optimized for high-frequency reproduction, and to avoid a loss in SPL at low frequencies by connecting all of the drivers in the array to the low-frequency signal. Thus, power loss is minimized. Since low-frequency sound pressure levels contribute more to the perceived loudness or volume of audio than high-frequency signals, the apparent loudness is not adversely affected by the use of the arrays configured in accordance with embodiments of the present invention. Moreover, decomposing the input signal into several bands enables selective design of the configuration of the arrays to enhance the frequency response by customizing the nonuniform spacing of the subarrays corresponding to the various decomposed bands. These configurations help to expand a listening sweet spot and hence to accommodate listener movement or multiple listeners in a room.

The foregoing description describes several embodiments of nonuniform, asymmetric arrays. While the embodiments describe details of arrays having three, four, and sometimes more drivers, the invention is not so limited. The scope of the invention is intended to extend to all nonuniform, asymmetric arrays, having at least three drivers, irrespective of the exact number of drivers. By configuring the arrays in accordance with the embodiments described, an improved response for a range of listening angles may be provided. Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A speaker array comprising:

a plurality of electrically coupled drivers formed in one of a curvilinear and linear array and comprising at least a first, second, and third driver, wherein the second driver is positioned adjacent to the first and third drivers and a first spacing between the first and second drivers is different from a second spacing between the second and third drivers; and wherein the first spacing and the second spacing corresponds to a configuration of the speaker array such that the magnitude of the frequency response in a selected frequency band of the human audible spectrum has a higher minimum value than other tested configurations of the speaker array.

2. The speaker array as recited in claim 1 wherein the plurality of electrically coupled drivers are asymmetrically placed in the array.

3. The speaker array as recited in claim 1 wherein the first spacing is one half of the second spacing.

4. The speaker array as recited in claim 3 wherein the array comprises a $4^{th}$ driver located adjacent to the first driver.

5. The speaker array as recited in claim 1 wherein the plurality of electrically coupled drivers are formed in a linear array.

6. The speaker array as recited in claim 1 wherein the plurality of electrically coupled drivers are formed as a first subset of an array of uniformly spaced drivers.

7. The speaker array as recited in claim 6 wherein at least one of the uniformly spaced drivers is electrically isolated from the plurality of electrically coupled drivers, the electrical isolation being provided using one of a bipolar transistor, a MOS transistor, and a mechanical switch.

8. The speaker array as recited in claim 1 wherein an input signal to the speaker array is filtered such that the plurality of drivers is responsive to a selected frequency band and forms a subset of the speaker array.

9. The speaker array as recited in claim 6 wherein an input audio signal is filtered into a first and second filtered signal, one of the filtered signals connected to the first subset, the first and second filtered signal respectively corresponding to two frequency bands, and the first filtered signal representing a lower frequency band than the second filtered signal.

10. The speaker array as recited in claim 9 wherein the first filtered signal is electrically coupled to the all of the drivers in the uniformly spaced array and the second filtered signal is electrically coupled to the plurality of electrically coupled drivers.

11. The speaker array as recited in claim 1 wherein the array comprises a first and second subarray, the first, second, and third drivers together forming at least a portion of at least one of the first and second subarrays, and wherein an input audio signal is filtered into a first and second filtered signal for electrical coupling respectively to at least the first and second subarray, and wherein the first and second filtered signal respectively corresponds to two frequency bands, the first filtered signal representing a lower frequency band than the second filtered signal.

12. The speaker array as recited in claim 11 further comprising a third filtered signal derived from the input audio signal, the third filtered signal electrically coupled to a third subarray of the speaker array.

13. A method of determining an optimized configuration of drivers in an array having a grid of candidate positions suitable for placement of a plurality of drivers, the method comprising:

selecting a first candidate configuration for each of at least a first, second, and third driver in the array, each of the drivers corresponding to a unique position in the grid;

selecting a second candidate configuration for each of the first, second, and third drivers in the plurality, each of the drivers corresponding to a unique position in the grid, the second test configuration being different from the first;

evaluating responses of the array in the first and second candidate configurations, each array response having corresponding troughs of specific depths;

comparing for each of the first and second candidate configurations the maximum attenuation over a predetermined response range, the comparison includes a comparison of the deepest trough for each configuration; and selecting one of the first and second candidate configurations for the array based on a comparison of the values of the maximum attenuation, the selection comprises either: (1) selecting the configuration having the highest signal value for the trough and further comprising storing the trough value as a stored trough value associated with its corresponding configuration; or (2) selecting the configuration wherein the measurement of the trough relative to a zero attenuation reference level is minimized.

14. The method as recited in claim 13 wherein evaluating the response of the array in the first and second candidate configurations comprises computing a discrete-time Fourier transform using the DFT implemented as an FFT, and wherein the predetermined response range comprises a predetermined frequency range in the DTFT.

15. The method as recited in claim 13 further comprising selecting a third test configuration, determining for the third test configuration the maximum attenuation value represented by its signal value at its deepest trough over the predetermined frequency band, comparing the maximum attenuation value for the third test configuration with the stored trough value, and replacing the stored trough value if the maximum attenuation value is greater than the stored trough value.

16. The method as recited in claim 15 wherein selecting a new third test configuration and comparing its maximum attenuation to the stored trough value is repeated until all configurations in the grid have been tested.

17. A method of determining an optimized configuration of drivers in an array, the method comprising:

determining the number of drivers in the array, the width of each driver, and the length of the array;

selecting a first position for a first driver relative to a second driver;

measuring the magnitude of the response for the first selected position;

storing the minimum value for the response in a first memory location;

selecting a second position for the first driver relative to the second driver; and measuring the response for the second position and replacing the value in the first memory location if the minimum value for the second response exceeds the value in the first memory location.

18. The method as recited in claim 17, wherein the array comprises at least a first, second, and third driver with a first spacing between the first and second drivers and a second spacing between the second and third drivers, the method further comprising:

determining the first spacing and the second spacing by configuring the drivers in the array such that the magnitude of the frequency response in a selected frequency band of the human audible spectrum has a higher minimum value than other tested configurations.

19. The method as recited in claim 17, wherein the magnitude of the response for each location is determined by computing a discrete-time Fourier transform (DTFT).

20. The method as recited in claim 19, wherein the computation of the DTFT is carried out using the DFT (discrete Fourier transform) implemented as an FFT (fast Fourier transform).

21. The method as recited in claim 17, wherein the array comprises:

a plurality of electrically coupled drivers formed in one of a curvilinear and linear array and comprising at least a first, second, and third driver, wherein the second driver is positioned adjacent to the first and third drivers and a first spacing between the first and second drivers is different from a second spacing between the second and third drivers.

* * * * *